US005834943A

United States Patent [19]

Miller

[11] Patent Number: 5,834,943

[45] Date of Patent: Nov. 10, 1998

[54] APPARATUS AND METHOD FOR SENSING FAILED TEMPERATURE RESPONSIVE SENSORS

[76] Inventor: Mark E. Miller, 233 Rosehill, Versailles, Ky. 40383

[21] Appl. No.: 756,194

[22] Filed: Nov. 25, 1996

[51] Int. Cl.[6] ..... G08B 21/00

[52] U.S. Cl. ..... 324/549; 324/711; 324/703; 340/640; 340/622

[58] Field of Search ..... 340/635, 640, 340/653, 622; 73/204.14, 295; 324/545, 712, 711, 703

[56] References Cited

U.S. PATENT DOCUMENTS

| | | | |
|---|---|---|---|
| 4,056,708 | 11/1977 | Soodak . | |
| 4,102,198 | 7/1978 | Hammarlund . | |
| 4,816,748 | 3/1989 | Tazawa | 324/711 |
| 5,034,725 | 7/1991 | Sorensen | 340/632 |
| 5,159,318 | 10/1992 | Kornberg | 73/295 |
| 5,272,427 | 12/1993 | Nold et al. . | |

*Primary Examiner*—Josie Ballato
*Assistant Examiner*—Jose M. Solis
*Attorney, Agent, or Firm*—Russell E. Baumann; Richard L. Donaldson; René E. Grossman

[57] ABSTRACT

A microprocessor control (10, 24) has one or more temperature responsive thermistor sensors (20, 26, 28) used to provide temperature inputs to control operation of a temperature control system. The microprocessor control subjects the thermistor sensors to a series of diagnostic tests prior to reading the thermistor sensors, the tests including short and open circuits, shorts to ground or power and leakage paths to ground. The thermistors, along with a reference resistor (R11, R26) form an RC charge circuit with a capacitor (C6, C6'). The capacitor is charged through each thermistor and reference resistor for selected open and short tests while a watch dog timer is used to determine the time taken to charge the capacitor via a timer capture port coupled to the capacitor. The temperature control system has a power supply having a logic ground and a chassis ground of different potentials which are utilized in the leakage test by turning off the power source to the thermistors and setting a watch dog period to determine if leakage through a respective thermistor to chassis ground has caused the capacitor (C6, C6') to charge sufficiently to cause a timer capture.

20 Claims, 8 Drawing Sheets

APPARATUS AND METHOD FOR SENSING FAILED TEMPERATURE RESPONSIVE SENSORS

BACKGROUND OF THE INVENTION

This inventions relates generally to temperature control systems and more particularly to a method and apparatus for sensing failed temperature sensors in such systems.

Temperature responsive thermistor sensors are commonly used in temperature control apparatus. In defrost applications, for example, one thermistor may be used to sense the temperature of ambient air and another thermistor may be used to sense the temperature of a liquid line in order to provide input signals to a control unit for controlling a defrost cycle. In another application a thermistor is disposed in an air supply duct to sense the temperature of supply air and provide an input to a control to determine when an indoor blower should be turned on or off and to vary the speed of the blower as required. It would be advantageous to use such thermistor sensors also as a limit control. For example, in the air duct connected to a fan for circulating heated air, the thermistor could be used in order to sense over-temperature conditions and turn off the heat source before fuse line breaks are actuated. This arrangement would result in a system which could not be bypassed by shorting or opening the thermistor circuit since the control's microprocessor would detect such conditions and shut down the system. The air duct thermistor can also be used to turn off the fan following de-energization of a heat source based on the actual temperature of the air rather than some arbitrary time delay.

However, a problem occurs when a sensor fails. A failed sensor results in erroneous readings and interferes with normal operation of the system. With regard to outdoor units, a typical mode of failure is for the insulative layer encasing the thermistor to develop cracks thereby allowing moisture to permeate and create a leakage path to ground causing faulty readings. As a result, the control unit fails to initiate a defrost cycle when needed due to the erroneous readings thereby causing the unit to ice up. By the time the thermistors are tested they often have dried out and appear to function properly so that finding the reason for the malfunction is often very difficult. In dealing with operational problems in the field it turns out that thermistor sensors are the least reliable component in the control unit. With regard to indoor air duct sensors, the limited reliability of the sensors is also a reason against using thermistor sensors as limit devices.

SUMMARY OF THE INVENTION

It is an object of the invention to provide a method and apparatus for sensing failed temperature responsive thermistors. Another object is to provide a method and apparatus for providing an indication of a failed sensor in a temperature control system and to prevent disruption of operation of the system. Yet another object is the provision of a method and apparatus which will revert to a selected default operation upon the occurrence of a thermistor failure.

Briefly, in accordance with the invention, a microprocessor control circuit having a thermistor sensor input subjects the sensor to a series of tests prior to taking a reading of the sensor. The tests sense for different fault conditions including short and open circuits, shorts to ground or power and leakage paths to ground. According to a preferred embodiment shorts are sensed by establishing a minimum charge time for a capacitor charged through the thermistor while opens are sensed by establishing a maximum charge time for charging the capacitor through the thermistor. Shorts to ground or power are sensed by charging the capacitor through a reference resistor and comparing the charge time to upper and lower limits for this reading. According to a feature of the invention, leakage paths to ground are detected by utilizing a potential difference between logic and chassis ground. All outputs are turned off and the timer capture pin of the microprocessor is enabled for a selected period of time so that if a leakage path significant enough to affect the circuit exists the capacitor will be charged causing a capture. In one embodiment the control uses inputs from a room thermostat and a supply air duct thermistor sensor to determine when an indoor blower should be turned on and off as well as to power resistive electric heating elements. In a modified embodiment, thermistor sensors include an ambient air thermistor and a liquid line thermistor provided to initiate defrost cycles as required in a defrost control on an outdoor unit. In another modified embodiment an A/D circuit is used for testing the thermistor sensor for fault conditions.

DESCRIPTION OF THE PREFERRED EMBODIMENTS

Figure 1:
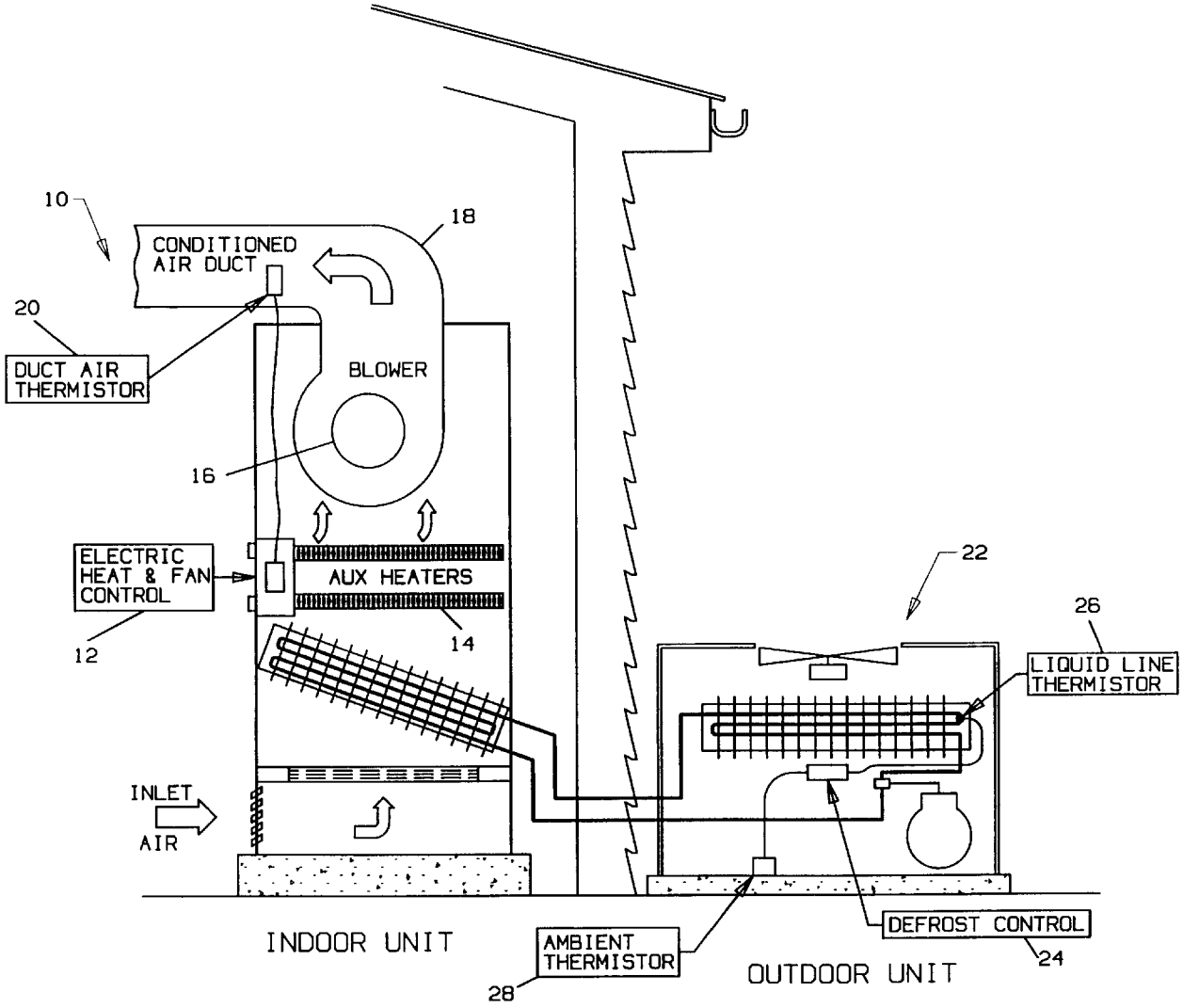
FIG. 1 is a schematic representation of an indoor unit having an electric heat and fan control system and an outdoor unit having a defrost control system.

With regard to FIG. 1 an indoor temperature control system 10 is shown comprising an electric heat and fan control 12, heaters 14, a blower fan 16 in a conditioned air supply duct 18. A temperature responsive sensor in the form of a duct air thermistor 20 is mounted in duct 18 and is electrically connected to control 12.

An outdoor temperature control unit 22 is also shown including a defrost control 24 with temperature responsive sensors in the form of a liquid line thermistor 26 thermally coupled to the liquid line of an evaporator unit and ambient thermistor 28 exposed to ambient air electrically connected to defrost control 24.

Figure 2A:
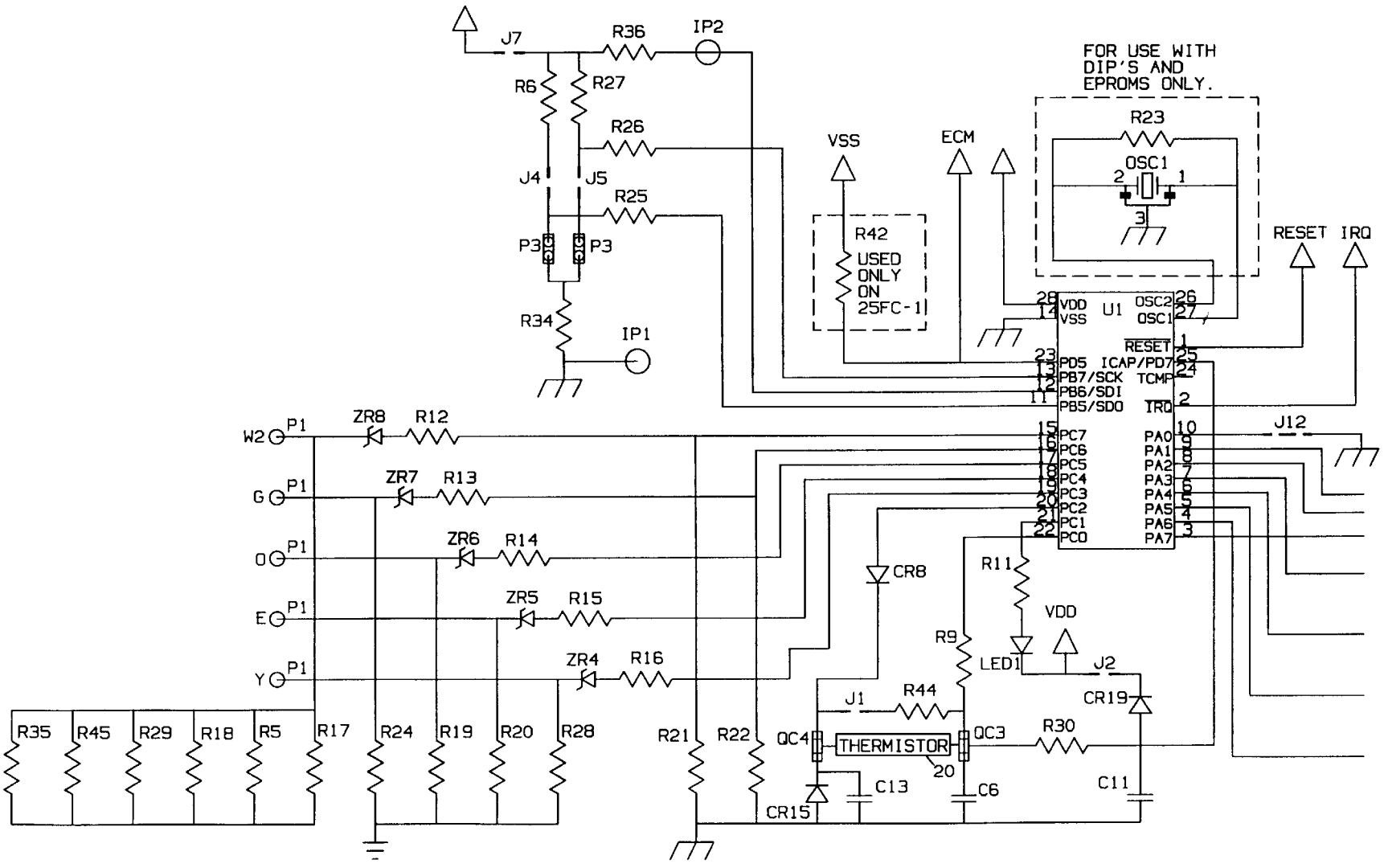
FIGS. 2*a* and 2*b* are a schematic of the control system for the indoor unit of FIG. 1.
Figure 2B:
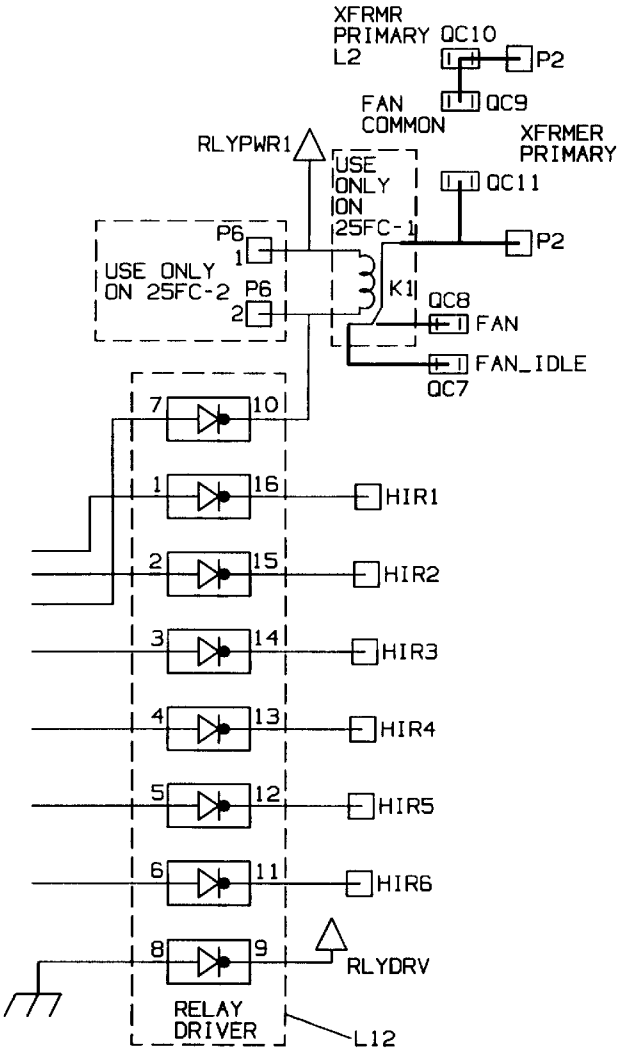

With particular reference to FIGS. 2–7, the invention will be described as applied to indoor unit 12. Referring first to FIG. 2, control 12 comprises microprocessor U1 with inputs at pins 15–19 respectively from terminals W2 (second stage heat), G (fan), O (reversing valve), E (emergency heat), and Y (compressor) through respective zener diodes ZR8, ZR7, ZR6, ZR5, ZR4, resistors R12–R16 and pull down resistors connected to chassis ground including parallel connected resistors R17, R5, R18, R29, R45, and R35 for W2, R24 for G, R19 for O, R20 for E, and R28 for Y. The above input portion of the circuit is conventional and will not be described in detail. A description of a similar input can be obtained in coassigned U.S. Pat. No. 5,272,427, the subject matter of which is incorporated herein by this reference.

Pins 20 and 22 of microprocessor U1 are connected to quick connects QC4 and QC3 respectively for connection to a sensing thermistor. Quick connect QC4 is connected between the cathodes of diodes CR8 and CR15 and to logic ground with capacitor C13 coupled around diode CR15. Quick connect QC3 is connected between a reference resistor R9 and capacitor C6 in turn connected to logic ground. QC3 is also connected through resistor R30 to the time capture T CAP pin 25 of the microprocessor. Capacitors C13, C11, diode CR15, resistors R30, R44 provide circuit protection functions.

Input pins 11, 12 and 13 are coupled to a jumper block P3 which provides a means for selecting the minimum air supply temperature for the heating mode, i.e., 85° F., 90° F., 95° F. and 100° F.

Off board relays for turning on or off banks of heaters, HTR1–HTR6 respectively, are controlled through relay driver integrated circuit U2 coupled to output pins 9-3 respectively. A standard oscillator OSC1 is connected to pins 26, 27 to provide a selected frequency of 2 mHz, although other frequencies can be employed, if desired.

Figure 3B:
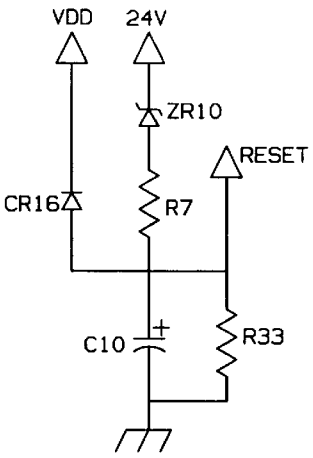
FIG. 3*a* is a schematic of the IRQ circuit used with the FIG. 2 schematic and FIG. 3*b* is a schematic of the RESET circuit used with the FIG. 2 schematic.
Figure 3A:
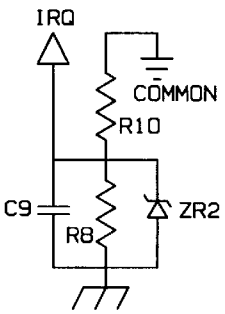

With respect to FIG. 3*a,* the IRQ circuit connected to pin 2 of microprocessor U1 provides synchronization to the AC line to read the several inputs in the same manner as in U.S. Pat. No. 5,272,427, referenced supra, and illustrates the use of two different potentials, chassis ground and logic ground. Common or chassis ground is shown as an input to the IRQ circuit. The reset circuit of FIG. 3*b* tied to pin 1 of microprocessor U1 is used for brown out power interruption to ensure that the microprocessor powers up as intended. That is, it ensures that the 5 volt supply VDD comes up before the reset circuit comes up in a conventional manner.

Figure 4:
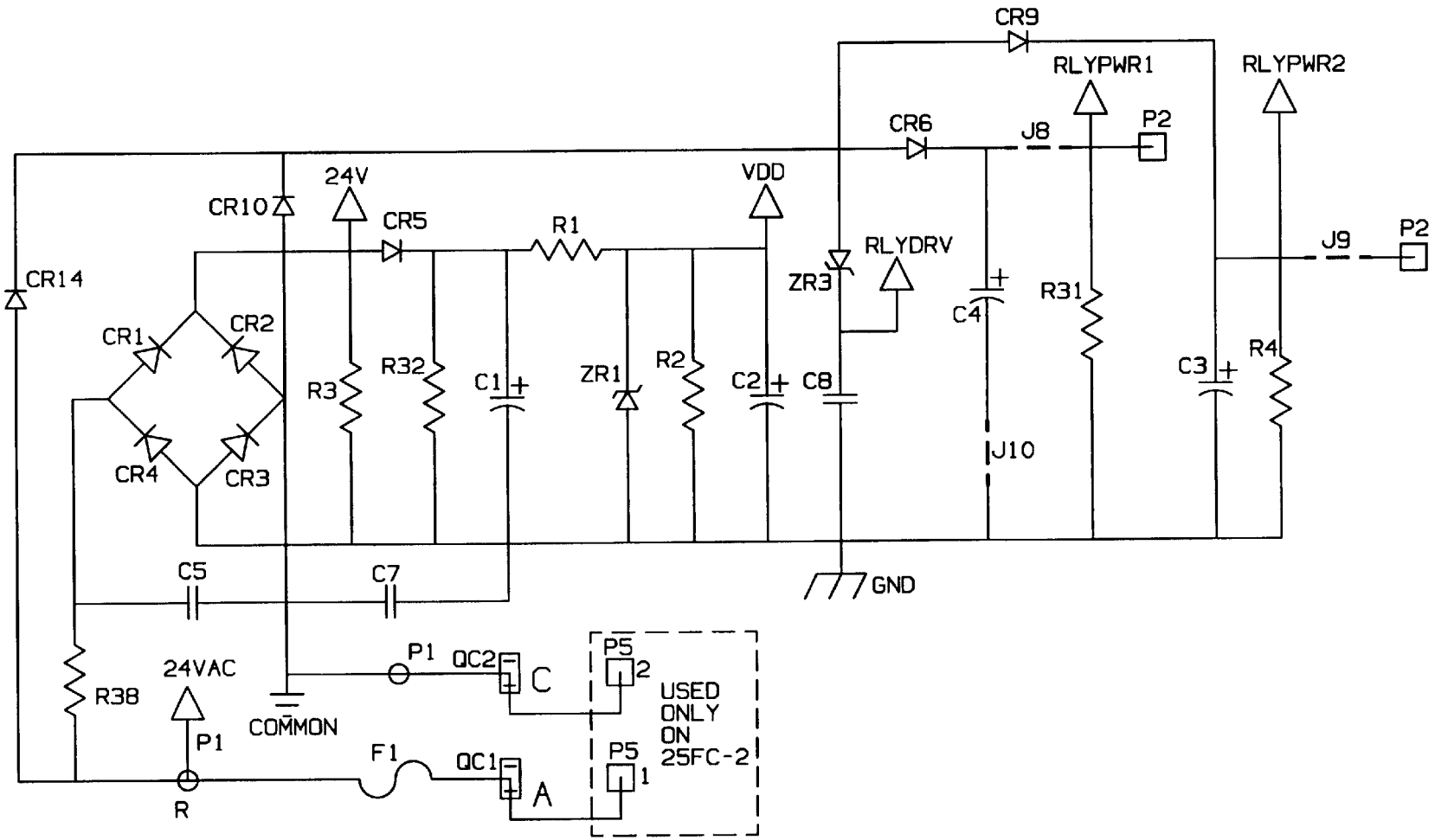
FIG. 4 is a schematic of the power supply used with the FIG. 2 schematic.

The power supply network connected to VDD pin 28 of microprocessor U1 is shown in FIG. 4. Incoming power supply 24 VAC shown at R and common are connected to a full wave bridge, diodes CR1–CR4 from which logic ground is derived at the anodes of diodes CR3, CR4. A 5 volt power supply is provided by capacitor Cl, current limiting resistor R1 and a 5 volt zener diode ZR1. The remaining components, resistors R2, R32, capacitor C2 etc., provide pull down, noise decoupling and the like. Capacitors C4, C3 and associated components provide power for off board relays.

The control utilizes an algorithm including logic that determines the mode of operation based upon room thermostat input and supply air thermistor input. When a need for electric heat has been determined the control will energize the minimum amount of heat needed to raise the supply air temperature to a minimum set point and operates a variable speed motor by a pulse width modulated (PWM) signal based on the desired rate of air flow (cubic feet per minute or CFM) and mode of operation.

Figure 5:
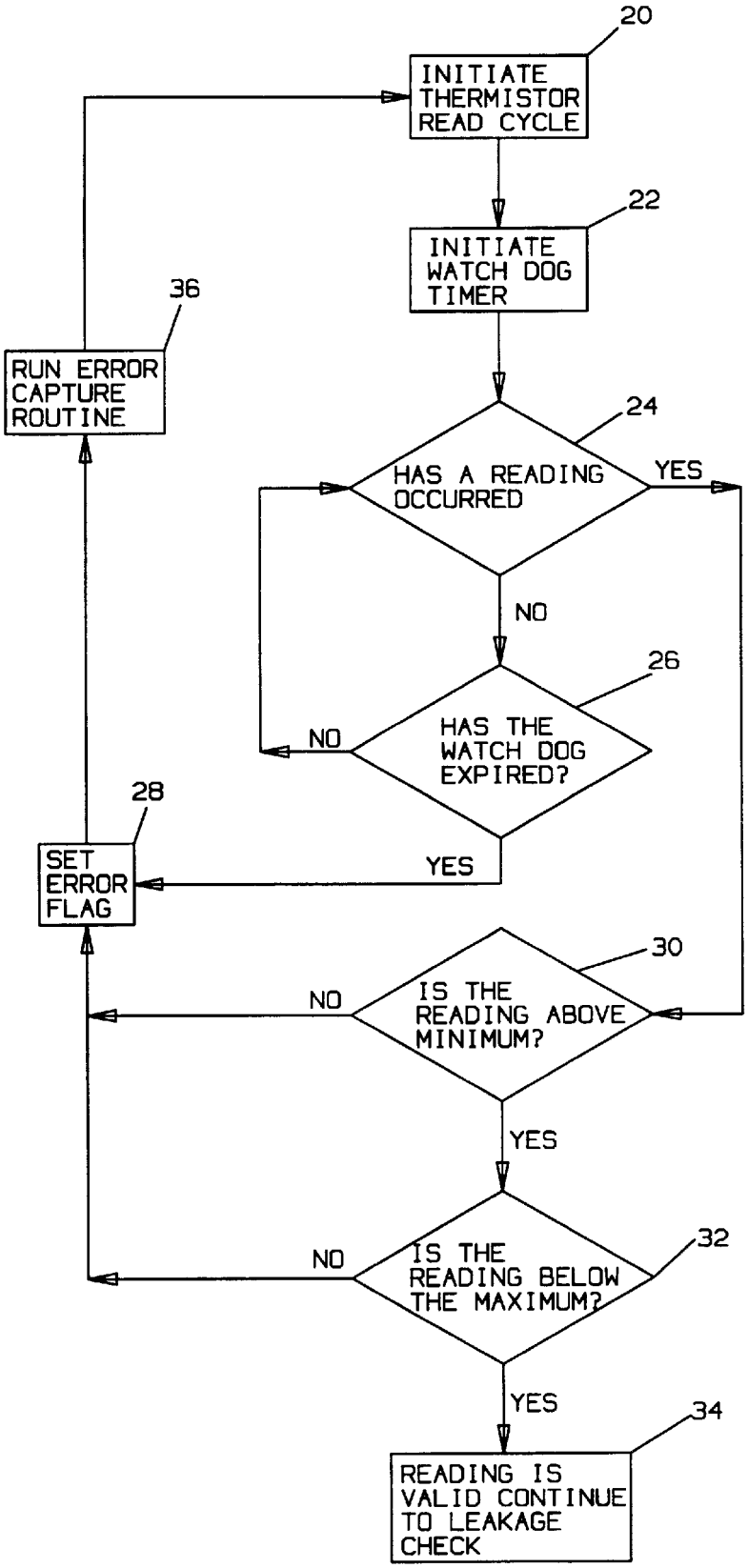
FIG. 5 is a thermistor read routine for detecting shorts and opens in accordance with the invention.

Referring back to FIG. 2, the thermistor 20 and capacitor C6 form a timed charge circuit using a digital input. When pin 20 (PC2) is turned on a timer is initiated. When capacitor C6 charges to a level high enough for timer capture pin 25 (T CAP/PD7) to see a high the timer is stopped. The particular routine for detecting shorts and opens is shown in FIG. 5. The read cycle is initiated at step 20, a watch dog timer is initiated at step 22 and a decision step at 24 checks to see if a reading has occurred. If not, the routine goes to decision block 26 to see if the watch dog timer has expired and if not, it cycles back to step 24. If the watch dog timer has expired an error flag is set at block 28. If a reading has occurred at decision step 24, then the routine goes on to decision step 30 to see if the reading is above a selected minimum value. The minimum reading is used for detecting a shorted thermistor. If not, an error flag is set at block 28 and if the reading is above the minimum the routine goes to decision block 32 to check if the reading is below a selected maximum. The maximum reading and watch dog timer are used to detecting opens. If the reading is not below the maximum, an error flag is set at block 28 but if the reading is below the maximum then it is considered valid, step 34, and the routine goes onto a leakage check routine. When an error flag is set at block 28 an error capture routine is run at step 36 with the routine then going back to block 20.

Figure 6:
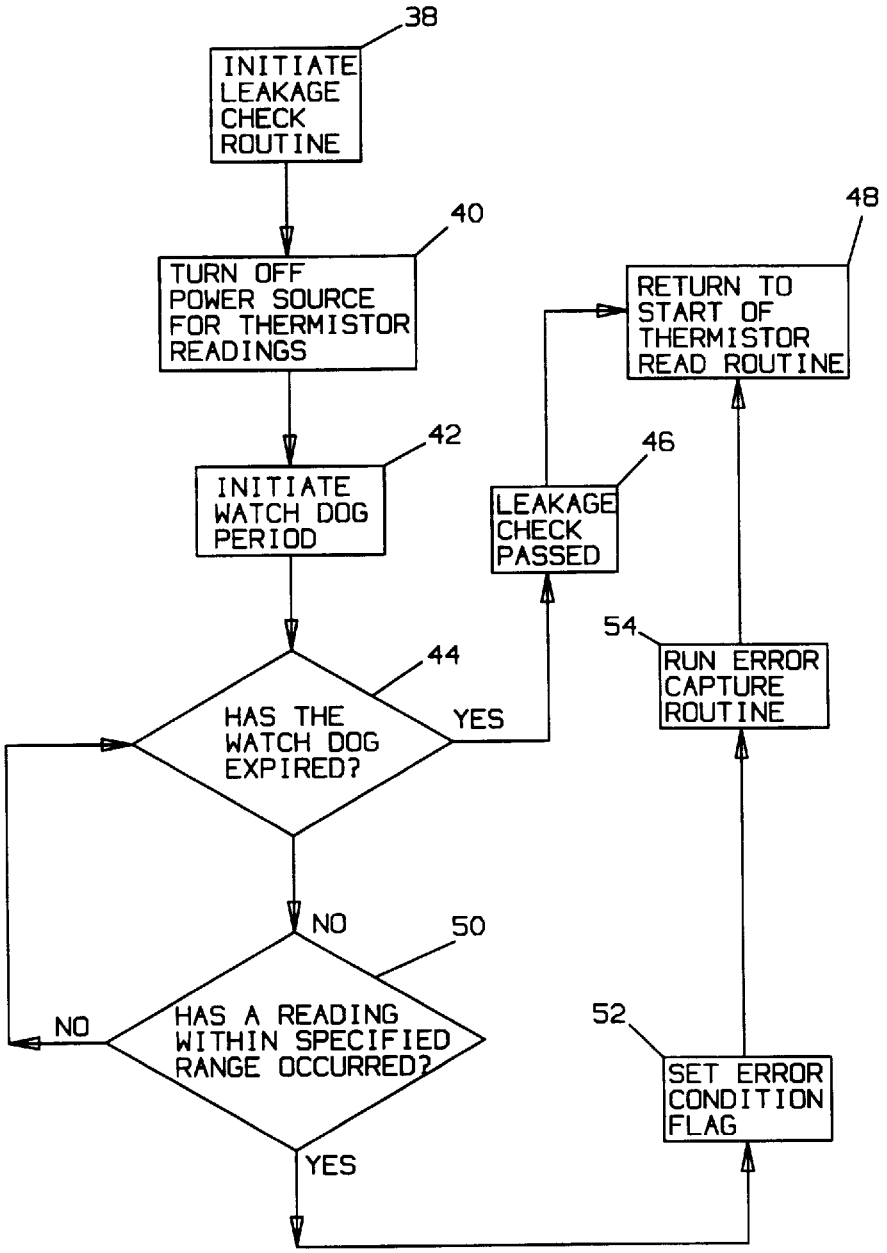
FIG. 6 is a thermistor leakage check routine in accordance with the invention.

Thermistor leakage is checked by a routine shown in FIG. 6. The routine is initiated at step 38. At step 40 the power source for the thermistor readings is turned off, i.e., pins 20, 22 and a watch dog period of time is initiated at step 42. Decision block 44 checks to see if the watch dog period has expired and if so the routine goes to step 46 with the leakage test being passed and then to step 48 which returns to step 20 of the thermistor read routine. If the watch dog time period has not expired, the routine from decision block 44 goes to decision block 50 to see if a reading within a specified range has occurred. If not, the routine cycles back to block 44 and if such reading has occurred an error condition flag is set at process step 52. An error capture routine is run at process step 54 and the routine goes on to block 48.

Figure 7:
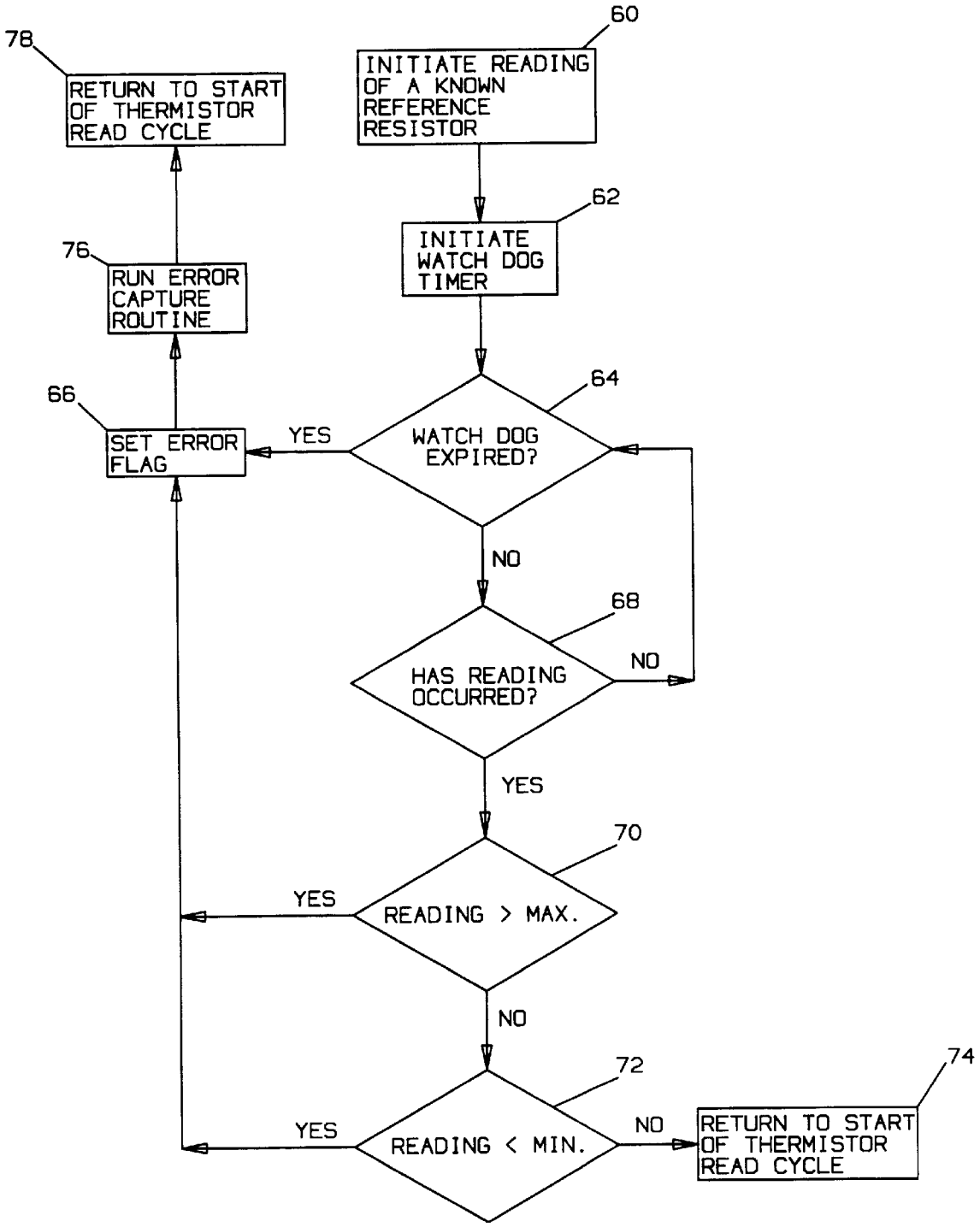
FIG. 7 is a thermistor read routine for detecting shorts to chassis ground or to 24 VAC in accordance with the invention.

The routine for detecting shorts to chassis ground or 24 VAC is shown in FIG. 7. Depending upon the severity of the short, this condition may be sensed as a leakage path, discussed supra, prior to being diagnosed as a short to chassis ground or 24 VAC. The routine involves the initiation of the readings of a known reference resistor R9 at step 60, the initiation of a watch dog timer at process step 62, the decision block 64 to determine whether the watch dog has expired. If the watch dog has expired, an error flag is set at block 66; if it has not expired, the routine goes on to decision block 68 to determine whether a reading has occurred. If no reading has occurred, the routine cycles back to step 64 but if a reading has occurred the routine goes on to decision block 70 to determine if the reading is greater than a selected maximum value and if not on to decision block 72 to determine whether the reading is less than a selected minimum value. If the decision is yes at either decision block 70, 72 an error flag is set at block 66. If the decision is negative at decision block 72 the routine goes on to block 74 and returns to the start of the thermistor read routine (block 20). If a flag is set at block 66, an error capture routine is run at process step 76 and then the routine proceeds to block 78 and returns to the start of the thermistor read cycle. It will be noted that the FIG. 7 routine is very similar to that of the FIG. 5 thermistor read routine; however, the minimum and maximum values are tightly controlled since a known value R9 is being read. Suitable decimal values for the minimum and maximum are noted below in table 1.

| | MAX | MIN |
|---|---|---|
| Reference Resistor (R9) | 352 | 32 |
| Thermistor | 13928 | 16 |

These values represent the number of microprocessor clock cycles counted while waiting for the R-C circuit to charge. It will be understood that for an A/D circuit the appropriate values would be the minimum and maximum A/D readings taken rather than clock cycles.

A very short charging time reflects a short condition, i.e., a time less than the minimum value. On the other hand, a charge time exceeding the maximum reflects an open condition. With respect to thermistor leakage, by turning off inputs at pins 20 and 22, there should be no charging; however, if a leakage path through the thermistor to another voltage source exists this can be detected at time capture pin 25 (T CAP/PD7) during a selected watch dog period. That is, the leakage path through the thermistor is to chassis ground which is at a different potential than logic ground. If the thermistor sensor is determined to have failed the control can be adapted to go into a selected default operation, e.g., turn on the blower fan.

Figure 8:
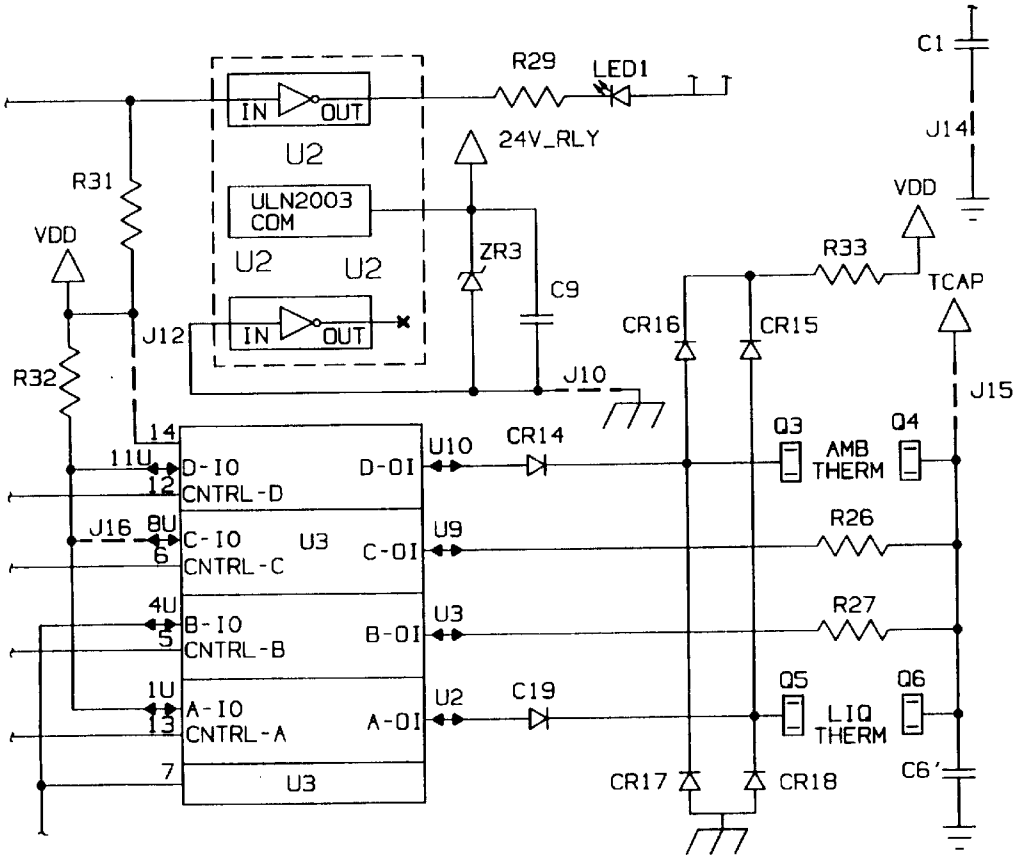
FIG. 8 is a schematic of a portion of the control system of the outdoor unit depicted in FIG. 1 including the sensor portion.

FIG. 8 shows a modification relating to an outdoor unit such as the one depicted in FIG. 1. As shown in FIG. 8, connections Q3, Q4 and Q5, Q6 are for connecting an ambient temperature thermistor and a liquid line temperature thermistor, respectively. The thermistors are coupled to U3 which functions as an analog switch. That is, 5 volts from VDD can be switched onto any one of lines U10, U9, U3 or U2. The microprocessor (not shown) selects the appropriate charge path through switch U3 to charge capacitor C6' through either the ambient thermistor, the liquid line thermistor or a reference resistor R26. Resistor R27 is a discharge resistor in order to discharge capacitor C6' prior to the commencement of a charge cycle. After discharging capacitor C6' the appropriate thermistor or reference resistor is enabled and the watch dog timer initiated as in the FIG. 2 embodiment. When the time capture pin goes high the time is captured in the same manner as in the FIG. 2 embodiment. If a failed thermistor is detected the control, as in the previous embodiment, can be adapted to go into default operation. For example, if the ambient sensor fails the ambient readings can be taken using the liquid line thermostat when the unit is off. On the other hand, if the liquid line sensor fails then the control can go into a timed defrost operation thereby avoiding damage.

Most defrost problems with outdoor units evolve from sensor failure which, at times, is difficult to diagnose, as noted supra. Frequently, sensors have microscopic cracks in their insulative encapsulant thereby providing a leakage path which dry up by the time a field technician has an opportunity to visit the site and, when dry, the sensor works as intended. By means of the invention such sensors are detected at the time of failure and a suitable default operation is initiated as long as the fault condition is in existence. The invention also allows the use of a thermistor as a limit device for the first time. In the past, a separate fuse or thermostatic device was required to provide protection for overheating conditions.

A control circuit made in accordance with the FIGS. 2–4 embodiment comprise the following components:

| | | | | |
|---|---|---|---|---|
| R1 | 1.1K | 2W | R44 | 5.1M ⅛W |
| R2 | 10K | ¼W | R45 | 1.5K 2K |
| R3 | 2K | ¼W | U1 | MC68HC05P97 (MOTOROLA) |
| R4 | 10K | ¼W | U2 | ULN2003 |
| R5 | 1.5K | 2W | LED1 | Radial |
| R6 | 100K | ⅛W | OSC1 | 59275-1 |
| R7 | 1K | ¼W | ZR10 | 59231-0126-12V |
| RB | 100K | ⅛W | ZR1 | 59231-0115-5.1V |
| R9 | 5.11K | ¼W | ZR2 | 59231-0115-5.1V |
| R10 | 10K | ⅛W | ZR3 | 59231-0144-43V |
| R11 | 2K | ⅛W | ZR4 | 59231-0126-12V |
| R12 | 200K | ⅛W | ZR5 | 59231-0126-12V |

-continued

| | | | | |
|---|---|---|---|---|
| R13 | 200K | ⅛W | ZR6 | 59231-0126-12V |
| R14 | 200K | ⅛W | ZR7 | 59231-0126-12V |
| R15 | 200K | ⅛W | C1 | 47mF-50V |
| R17 | 1.5K | 2W | C2 | 10uF |
| R18 | 1.5K | 2W | C3 | 100uF-50V |
| R19 | 1.5K | 2W | C4 | 47uF-50V |
| R20 | 1.5K | 2W | C5 | .1uF-100V |
| R21 | 51K | ⅛W | C6 | .1uF-50V |
| R22 | 51K | ⅛W | C7 | .1uF-10QV |
| R23 | 1M | ⅛W | C8 | .1uF-100V |
| R24 | 1.5K | 2W | C9 | .01uF-50V |
| R25 | 2K | ⅛W | C10 | 10uF-16V |
| R26 | 2K | ⅛W | C11 | .0056uF-50V |
| R27 | 100K | ⅛W | C13 | .0056uF-50V |
| R28 | 1.5K | 2W | CR1 | 59226-0007 |
| R29 | 1.5K | 2W | CR2 | 59226-0007 |
| R30 | 1.1K | 2W | CR3 | 59226-0007 |
| R31 | 10K | ¼W | CR4 | 59226-0007 |
| R32 | 10K | ¼W | CR5 | 59226-0007 |
| R33 | 51K | ⅛W | CR6 | 59226-0007 |
| R34 | 10K | ⅛W | CR8 | 59320-1001 |
| R35 | 1.5K | 2W | CR9 | 59226-0007 |
| R36 | 100K | ⅛W | CR15 | 59320-1001 |
| R38 | 100K | 2W | CR16 | 59320-1001 |
| R42 | 10K | ⅛W | CR19 | 59320-1001 |

As noted above, if desired, an analog to digital, A/D, network can be used in place of the timed charge circuit described above. In such a modified embodiment, referring to FIG. 9, thermistor 20 and resistor R46 form a voltage divider with their junction 30 tied to an A/D input 32 of the microprocessor. The voltage divider is connected between a reference voltage source 34, e.g., 5–7 volts, and logic ground. An npn bipolar transistor Q1 is coupled across the voltage divider with its emitter connected to logic ground and its base, through drive resistor R47, to I/O port 36 of the microprocessor. A small current limiting resistor R48, e.g., 100 ohms, is connected to the collector of transistor Q1. The reference voltage source 34 is coupled to reference voltage input 38 of the microprocessor. A blocking diode CR20 has its cathode connected to resistor R46 for a purpose to be described below. The value of reference R46 is selected based on the particular range of thermistor resistance being measured.

Figure 9:
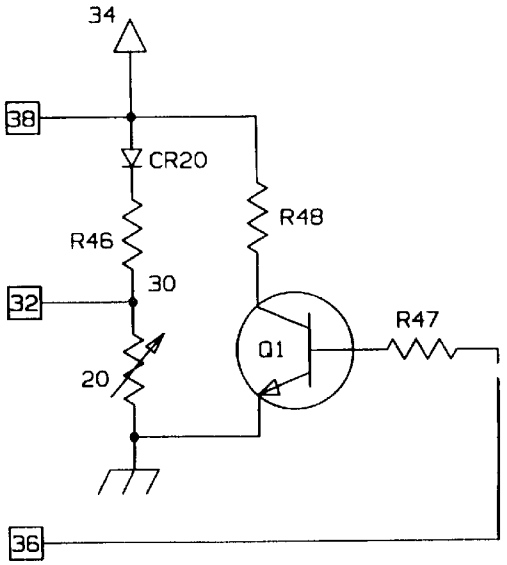
FIG. 9 is a schematic of a modified embodiment of a portion of a control system made in accordance with the invention.

In the FIG. 9 embodiment the microprocessor converts the analog voltage level to a relative bit number, e.g., an 8 bit number. For an open circuit condition the bit number would equate to the reference voltage minus one diode drop while a short circuit condition would result in a bit number equating to ground voltage. In conducting a leakage test transistor Q1 is turned to short the reference voltage source to ground and then a reading is taken at the A/D input 32. A reading above a threshold level equivalent to ground voltage indicates that leakage has occurred from chassis ground. Diode CR 20 prevents any signal from getting back to the reference voltage source.

Although the FIG. 9 embodiment adds some cost to the system it offers the advantage of a simplified approach regarding timing since it provides essentially instantaneous readings.

Numerous variations and modifications of the invention will become readily apparent to those familiar with HVAC controls. The invention should not be considered as limited to the specific embodiments depicted but rather as defined in the claims.

The LST file for the thermistor diagnostics is set forth as attached herewith:

-18-

```
          OPT   NOL
*****************************************************************************
*                                                                           *
*        MODULE NAME : RD_THRM.ASM                                          *
* ORIGINAL AUTHOR(S) : MARK EIFLER                                          *
*            PURPOSE : THIS ROUTINE READS A REFERENCE RESISTOR AND          *
*                      THERMISTOR RC TIME CONSTANT USING THE TCAP PIN OF    *
*                      THE P7/9 MICRO-CONTROLLER. IT THEN DIVIDES THE       *
*                      TWO AND GIVES AN RATIOMETRIC ANSWER.                 *
*                                                                           *
*      DATE      REV    REVISOR    CHANGES MADE                             *
*      ----      ---    -------    ------------                             *
*                 A       N/A      INITIAL VERSION                          *
*                                                                           *
*****************************************************************************
          OPT   L

*****************************************************************************
*                      READ THERMISTORS SUBROUTINE                          *
*****************************************************************************

RD_THRM
          LDX   TCAPHI              subtract start time from finish time...
          LDA   TCAPLO              ... and save

          BCLR  TCAP,TCR          ... disable the TCAP interrupt until another
*                                     thermistor input is initiated in the
          SUB   ALTEMP+1            THERM_POL routine
          STA   ALTEMP+1

          TXA
          SBC   ALTEMP
          STA   ALTEMP


          BRSET LK_DONE,FLAGREG3,NO_LKS
          BSET  LK_ERR,ERR_REQ
          JMP   RD_ERROR

NO_LKS
          INC   NUMSAMP
          LDA   NUMSAMP

          CMP   #8
          BLO   DONE_1

          BRSET READFLG,FLAGREG3,OVR_RD

          BSET  READFLG,FLAGREG3
          CLR   NUMSAMP

DONE_1    LDA   ALTEMP+1
          ADD   LSBCNTR             add TCR value to previous samples value
          STA   LSBCNTR             save TCR value when done in LSB counter
          LDA   ALTEMP
          ADC   MSBCNTR             add the additions carry to the MSB counter
          STA   MSBCNTR             save the MSB count

          BCC   NO_OVRFL
```

-19-

```
          BSET  CARRY,FLAGREG

NO_OVRFL  LDX   NUMSAMP
          BEQ   RDS_DONE

OVR_RD    RTS

DVSOR     EQU   REFMSB              prepare for ratio calculation, divisor...
DVDND     EQU   MSBCNTR             ... reference thermistor value, dividend...
*                                   ... the other thermistor value


RDS_DONE  LDX   #3

          BRCLR CARRY,FLAGREG3,AVERAGE
          SEC
          BCLR  CARRY,FLAGREG3


AVERAGE   ROR   MSBCNTR             divide the final value by number of...
          ROR   LSBCNTR             ... samples to compute average
          DECX                      3 shifts equals divide by 8
          CLC
          BNE   AVERAGE


          LDA  DDRC                .. determine if the LEAK check operation
          CMP  #THRMLKDDRC            was in progress
          BEQ  REF_NTOK            .. if in LEAK chk mode, goto error routine

          BRSET REF,DDRC,REF_ONN
          BRSET DUCT,DDRC,CHK_DUCT ... Puts REF reading in dvsor location

          BRA   REF_NTOK


REF_ONN   BRCLR REF,PORTC,REF_NTOK

          LDA   REFLSB2          ... average the rererence resistor reads
          BNE   NOT_1PASS          save initial values on first pass and
          LDX   REFMSB2            then keep rolling average
          BNE   NOT_1PASS

          LDA   MSBCNTR
          LDX   LSBCNTR
          BRA   FIRST_REF


NOT_1PASS LDA   LSBCNTR              else get LSB counter value and...
          ADD   REFLSB2               ... maintain a running average for noise...
          TAX                        ... filtering
          LDA   MSBCNTR
          ADC   REFMSB2
          LSRA
          RORX

FIRST_REF

          CMP   #1               .. the REF value must be in the following range
          BHI   REF_NTOK
```

-20-

```
          BLO    CHK_REFLO

          CPX    #$08
          BLO    REF_OK                    $0020 < REF < $0108
          BRA    REF_NTOK          nominal reference reading 0087H

CHK_REFLO CPX    #$20           .. if out of range, set a reference resistor
          BHI    REF_OK            ERROR!!

REF_NTOK  BSET   REFERR,ERR_REQ

          BRA    RD_ERROR

REF_OK
          STA    REFMSB2
          STX    REFLSB2

          BCLR   REFERR,ERR_REQ

REF_ERROR JMP    RTN_EXIT

*
***  DUCT AIR THERMISTOR AVERAGING
*

CHK_DUCT BRCLR DUCT,PORTC,RD_ERROR

          TST    LL_READ         .. data will be ZERO's during first pass
          BNE    NON_1PASS
          TST    LL_READ+1
          BNE    NON_1PASS

SKIP_AVG  LDA    MSBCNTR         ... if this is the first time data, then store
          LDX    LSBCNTR             the values with no averaging

          BRA    NO_AVG1

NON_1PASS BRSET DLYOFF,FLAGREG,SKIP_AVG    ... skip the rolling average if the
*                                               control is in fan delay off
          BRSET TST_FLG1,FLAGREG2,SKIP_AVG ... skip the rolling average if the
*                                              control is in test mode
*
          LDA    LSBCNTR        .. after first pass, maintain rolling average
          ADD    LL_READ+1         of all DUCT AIR thermistor reads for noise
          TAX                         ... filtering
          LDA    MSBCNTR
          ADC    LL_READ
          LSRA
          RORX

NO_AVG1   STA    LL_READ       .. store rolling average value as well as set up
          STA    MSBCNTR          registers for 16 bit divide routine

          STX    LL_READ+1
          STX    LSBCNTR

DIV_DSN
          LDA    REFMSB2       ..reset the DVSOR for the division routine
          STA    DVSOR
```

-21-

```
          LDA   REFLSB2
          STA   DVSOR+1

          LDA   MSBCNTR
          BNE   DIVIDE
          LDA   LSBCNTR
          CMP   #20                 get divisor
          BHS   DIVIDE              compare divisor MSB to dividend MSB
*                                   else divide
SET_ERR   BSET  DUCTSHT,ERR_REQ

RD_ERROR  JSR   T_ERROR1
          RTS

DIVIDE    LDX   #8                  prescale dividend for division by left...
NXT_BIT1  CPX   #0                  ...shifting number no more than 8 shifts
          BEQ   STRT_DIV            if 8 shifts done then go start division
          LDA   DVDND               else get dividend
          TST   DVDND               if MSBit is 1 then...
          BMI   STRT_DIV            go start division
          ASL   DVDND+1             else shift LSB left
          ROL   DVDND               shift MSB left with LSB carry
          DECX                      decrement bit counter
          STX   BITCNT1             save number of shifts left for later
          BRA   NXT_BIT1            go do next bit

STRT_DIV  JSR   DIV_16

**
***  DUCT AIR THERMISTOR RATIO
**

END_DIV
          BRCLR DUCT,PORTC,RTN_EXIT

          LDA  DVDND+1
          STA  DUCTAIR+1

          LDA  DVDND
          STA  DUCTAIR

          BCLR  DUCTERR,ERR_REQ
          BCLR  DUCTSHT,ERR_REQ

RTN_EXIT  CLR  MSBCNTR
          CLR  LSBCNTR
RD_EXIT   RTS                       return from subroutine


*************************************************************************
*              16 BIT DIVISION ROUTINE                                  *
*************************************************************************


DIV_16    LDA   #1                  start division, load bit counter
          TST   DVSOR               check MSBit of divisor MSB
          BMI   DIV_2               if set then branch
DIV_1     INCA                      else increment to check next bit
          ASL   DVSOR+1             shift LSB left, MSBit into carry
```

-22-

```
          ROL   DVSOR        rotate MSB left, carry int.  SBit
          BMI   DIV_2        if MSBit set branch
          CMP   #17          all bits checks
          BNE   DIV_1        if not then branch and check next bit
DIV_2     STA   BITCNT2      else save bit count for later
          LDA   DVDND        load MSB of dividend into accumulator
          LDX   DVDND+1      load LSB of dividend into index register
          CLR   DVDND        clear MSB of dividend for result
          CLR   DVDND+1      clear LSB of dividend for result
DIV_3     STX   TEMPX        temporarily store index register
          STA   TEMPA        temporarily store accumulator
          TXA                transfer index and accumulator contents
          SUB   DVSOR+1      subtract divisor LSB from dividend LSB
          STA   TEMPX        store answer in temp X register
          LDA   TEMPA        load temp accumulator copy
          SBC   DVSOR        subtract divisor MSB from dividend...
*                            ... MSB with carry
          STA   TEMPA        store answer in temp A register
          LDX   TEMPX        get temp X value (dividend LSB-divisor LSB)
          BCC   DIV_4        if carry clear then branch
          TXA                else transfer index and accumulator contents
          ADD   DVSOR+1      add LSB of divisor to (dividend LSB...
*                            ... - divisor LSB)
          STA   TEMPX        save result in temp X
          LDA   TEMPA        get dividend MSB - divisor MSB
          ADC   DVSOR        add MSB of divisor to (dividend MSB...
*                            ... - divisor MSB)
          STA   TEMPA        save result in temp A
          CLC                clear the carry bit
          BRA   DIV_5        branch around the set carry
DIV_4     SEC                set carry bit
DIV_5     ROL   DVDND+1      shift dividend LSB left with carry
          ROL   DVDND        shift dividend MSB left with carry
          LSR   DVSOR        shift divisor MSB right with carry
          ROR   DVSOR+1      shift divisor LSB right with carry
          DEC   BITCNT2      decrement bit counter
          BNE   DIV_3        if not zero go do next bit

UN_PRP    LDX   BITCNT1      scale result back, get bit count from...
*                            ... pre-scale

NXT_BIT2  CPX   #0           compare to zero
          BEQ   END_DVSN     if equal then done
          ASL   DVDND+1      shift result LSB left
          ROL   DVDND        shift result MSB left with LSB carry
          DECX               decrement index register
          BRA   NXT_BIT2     check next bit

END_DVSN  RTS
```

-23-

```
        OPT   NOL
*************************************************************************
*                                                                       *
*        MODULE NAME : THRM_POL.ASM                                     *
*          AUTHOR(S) : MARK MILLER                                      *
*            PURPOSE : THIS MODULE IS PART OF THE THERMISTOR PROGRAM. IT *
*                      TRACKS WHAT THERMISTOR OR REF RESISTOR IS BEING  *
*                      READ.                                            *
*                                                                       *
*                                                                       *
*      DATE      REV    REVISOR    CHANGES MADE                         *
*      ----      ---    -------    ------------                         *
*      03-16-91   A       N/A      INITIAL VERSION                      *
*      04-03-91   B       MAE      ADDED THE WATCHDOG PET SUBROUTINE    *
*                                  CHANGED OUTPUT PORT TO PORTB         *
*      09-10-91   C       MAE      FURTHER DOCUMENTED CODE, CHANGED OUTPUT *
*                                  PORT TO USE AN EQUATED PORT TO BE SET *
*                                  UP BY EACH APPLICATION               *
*      07-29-92   D       MAE      REMOVED WATCHDOG PET                 *
*                                                                       *
*************************************************************************
        OPT   L

*************************************************************************
*                OUTPUTS ROUTINE (TIMER INTERRUPT HANDLER)              *
*************************************************************************


THRM_POLL

**********
***** THERMISTOR LEAKAGE TEST
**********

        BRSET  LK_DONE,FLAGREG3,REF_POLL
CHK_LKS
        LDA    #THRMLKDDRC
        STA    DDRC
        BCLR   DUCT,PORTC
        BCLR   REF,PORTC
        BRA    END_POLL


REF_POLL  BRSET  REFDONE,FLAGREG3,DUCT_POLL (DUCT_POLL)

          BRCLR  READFLG,FLAGREG3,RD_REF
          BSET   REFDONE,FLAGREG3
          BCLR   READFLG,FLAGREG3
***

***

          BRA    DUCT_POLL


RD_REF
          BCLR   DUCT,PORTC
          BSET   REF,PORTC
          LDX    #REFONDDR
```

-24-

```
          STX     DDRC
          BRA     END_POLL


DUCT_POLL BRCLR   READFLG,FLAGREG3,RD_DUCT
TST_JMP   BCLR    REFDONE,FLAGREG3
          BCLR    READFLG,FLAGREG3
          BCLR    LK_DONE,FLAGREG3

          LDA     ERR_REQ          ... if no errors are present, clear
          BNE     NOERRCLR             the error counter

          TST     ERR_CNT
          BEQ     CLR_ERR

          DEC     ERR_CNT
          BNE     NOERRCLR

CLR_ERR   LDA     ERR_REG
          AND     #%00010000
          STA     ERR_REG
NOERRCLR

          BRA     CHK_LKS


RD_DUCT
          BCLR    REF,PORTC
          BSET    DUCT,PORTC
          LDX     #DUCTONDDR
          STX     DDRC


***
********************
***

END_POLL
          LDX     ALTCNTHI         ... read and store the timer value
          LDA     ALTCNTLO             in RAM for use in the RD_THRM
          STX     ALTEMP               routine
          STA     ALTEMP+1

          BSET    TCAP,TCR         ... Enable the TCAP interrupt and clear
          TST     TCR                  the flag before leaving the routine
          TST     TCAPLO
          RTS
```

-25-

```
        OPT   NOL
 ***************************************************************************
 *                                                                         *
 *        MODULE NAME : OUTPUT.ASM                                         *
 *          AUTHOR(S) : MARK MILLER                                        *
 *            PURPOSE : THIS MODULE IS PART OF THE INTERFACE PROGRAM. IT   *
 *                      SETS THE OUTPUTS BASED ON TIMER INTERRUPT WHICH IS *
 *                      ASYNCHRONOUS TO THE 60 HZ REAL TIME CLOCK.         *
 *                                                                         *
 *                                                                         *
 *      DATE      REV    REVISOR    CHANGES MADE                           *
 *      ----      ---    -------    ------------                           *
 *      03-16-91   A       N/A      INITIAL VERSION                        *
 *      04-03-91   B       MAE      ADDED THE WATCHDOG PET SUBROUTINE      *
 *                                  CHANGED OUTPUT PORT TO PORTB           *
 *      09-10-91   C       MAE      FURTHER DOCUMENTED CODE, CHANGED OUTPUT *
 *                                  PORT TO USE AN EQUATED PORT TO BE SET  *
 *                                  UP BY EACH APPLICATION                 *
 *      07-29-92   D       MAE      REMOVED WATCHDOG PET                   *
 *                                                                         *
 ***************************************************************************
        OPT   L

 ***************************************************************************
 *                OUTPUTS ROUTINE (TIMER INTERRUPT HANDLER)                *
 ***************************************************************************

TIMERV
        JSR    HTR_ERR_CHK

        LDA   TOFCNT              get RTI counter
        INCA                      increment the RTI counter
        STA   TEST1

        CMP   #MAXTOF             compare to the max RTI's allowed without...
*                                 ... running main routine
        BLO   CNT_OK2             if lower then continue processing

        CLR   TOFCNT
        CLR   TCR
        SWI                       ... full reset

CNT_OK2 STA   TOFCNT             save RTI count

TCOM_RTN BRSET   TCOM,TSR,TCOM_SET
         JMP     TOF_RTN

TCOM_SET BSET   TCOMINI,FLAGREG

        LDX   ALTCNTHI            load and store the current RTC value...
        LDA   ALTCNTLO

        STA   TEMP1+1        ... temporary store clock count before
        STX   TEMP1              moving it to final location after

        ADD   ONEMSEC+1

        STA   TEMP1+1

        TXA
```

-26-

```
          ADC   ONEMSEC

          STA   TCMPHI

          LDA   TEMP1+1
          TST   TSR          ... initialize the LOW byte and clear the flag
          STA   TCMPLO

          BSET  TCOM,TCR

          INC  RANDOM
          LDA  RANDOM
          CMP  #20
          BLO  CHK_INPTS

          CLR  RANDOM

CHK_INPTS INC  FOURMSEC

          LDA  FOURMSEC      ... if 4 msecs has elapsed since the counter
          CMP   #4               was cleared, then read inputs
          BEQ  IN_READ

          BRCLR TST_FLG1,FLAGREG2,END_12MS .. if the TST flag was set,
*                                            determine if it is AC or DC
          CMP  #12                         .. if AC, then PB6 is high when
          BNE  END_12MS                       read at 12 msecs

          BRCLR TST_MFG,PORTB,END_12MS

          BSET  TST_FLG2,FLAGREG2       .. set flag for AC MFG test mode

END_12MS  RTI

IN_READ
          BSET   TCOMFLG,IFLGS
          BIH   END_TIMERV          if the interrupt line is now high then...
*                                   ... this is an invalid interrupt
          LDA   INPORT              we are now at mid-point so read the inputs
          AND   #%11111000
          CMP   INPUT1
          BEQ   UPDATE
          STA   INPUT1
          BRA   SKP_UPD
UPDATE    STA   INPUTS

SKP_UPD
          BRSET   TST_MFG,PORTB,NOMFG_TST

          BSET    TST_FLG1,FLAGREG2   .. set flag if TEST mode is being requested

NOMFG_TST LDA     DDRC           ...   if both thermistors are on, then the
          AND     #DSCHGDDR
          CMP     #DSCHGDDR           TCAP is discharging. Continue in this
          BEQ     SET_DSCHG           mode until discharge timer is up

          LDA     CHGCTR         ... if a thermistor is on, increment the
          INCA                       charge counter, this is a watchdog for
          CMP     #3                 the thermistor to verify that the
          BHS     THRM_ERR           TCAP pin is going high within a "given"
```

-27-

```
          STA     CHGCTR            number of AC cycles
          RTI

THRM_ERR  BRSET   TCAP,TSR,TCAP_RTN

          LDA  DDRC                 .. determine if the LEAK check operation
          CMP  #THRMLKDDRC             was in progress
          BNE  THRM_FAIL          .. if in LEAK chk mode, goto error routine

          BCLR    LK_ERR,ERR_REQ   ...
          BSET    LK_DONE,FLAGREG3
          BCLR    READFLG,FLAGREG3
          BRA     SET_DSCHG

THRM_FAIL BCLR    TCAP,TCR       ... if it has been too long charging then

          BRCLR   REF,PORTC,D_ERR
          BRCLR   REF,DDRC,D_ERR
          BSET    REFERR,ERR_REQ
          BRA     R_ERR

D_ERR
          BRCLR   DUCT,PORTC,SET_DSCHG
          BRCLR   DUCT,DDRC,SET_DSCHG
          BSET    DUCTERR,ERR_REQ


R_ERR     JSR     T_ERROR1          determine the source of the problem


SET_DSCHG
           CLR   CHGCTR          ... this is the TCAP discharge routine,
           LDA   #DSCHGDDR       ... reconfigure the port for the thermistor
           STA   DDRC               to be outputs
           BCLR  DUCT,PORTC      ... both REF and Thermistor inputs are
           BCLR  REF,PORTC          turned to outputs and turned ON

           LDA    DSCHGCTR            discharge occurs for 3 60HZ cycles
           INCA
           CMP    #DSCHGTIM
           BLS    INC_DCTR

           CLR    DSCHGCTR           once discharge is complete, the
********
           JSR    THRM_POLL           thermistor poll rtn will track which
           RTI                        thermistor is being read

INC_DCTR   STA    DSCHGCTR
           RTI


TOF_RTN    BRCLR  TOF,TSR,TCAP_RTN

           BSET    TOFLG,IFLGS

           LDA     TSR                 clear the TOF interupt flag
           LDA     TCNTLO

END_TIMERV
            JSR    HTR_ERR_CHK
```

-28-

```
            RTI

TCAP_RTN    BRCLR   TCAP,TSR,END_TIMERV

            BSET    TCAPFLG,IFLGS

            JSR     RD_THRM             read the thermistors and clear the
*                                       interupt flag
            CLR     CHGCTR
            CLR     DSCHGCTR          once discharge is complete, the

            BRA     SET_DSCHG                 go to update outputs from here

*****************************************************
******  HEATER ERROR CHECK ROUTINE            *********
** VERIFIES NO HEATERS ARE ON WHEN NOT REQUESTED    **
*****************************************************

HTR_ERR_CHK LDA     ERR_REG
            BNE     HTR_ERR1
            LDA     OUTPORT             combine thermistor outputs with
            AND     #%01111110
            BEQ     SAV_OUTC
            BRCLR   FAN,OUTPORT,HTR_ERR1

SAV_OUTC
            BCLR    ERR_SET,FLAGREG
TEMP_TST    LDA     OUTPORT
            STA     OUTCOPY             update output port
            RTS                        return from the interrupt

HTR_ERR1    BRCLR   ERR_SET,FLAGREG,SET_ERR2

            LDA     #%10000000
            STA     OUTPORT
            STA     OUTREQ
            STA     OUTCOPY

SET_ERR2    BSET    ERR_SET,FLAGREG
            RTS
```

-29-

```
        OPT   NOL
*****************************************************************************
*                                                                           *
*        MODULE NAME : T_ERROR.ASM                                          *
*          AUTHOR(S) : MARK MILLER                                          *
*            PURPOSE : THIS MODULE IS PART OF THE INTERFACE PROGRAM. IT     *
*                      SETS THE OUTPUTS BASED ON TIMER INTERRUPT WHICH IS   *
*                      ASYNCHRONOUS TO THE 60 HZ REAL TIME CLOCK.           *
*                                                                           *
*                                                                           *
*      DATE      REV    REVISOR    CHANGES MADE                            *
*      ----      ---    -------    ------------                            *
*      10-14-93   A       N/A      INITIAL VERSION                         *
*                                                                           *
*****************************************************************************
        OPT   L

*****************************************************************************
*           THERMISTOR ERROR ROUTINE                                        *
*****************************************************************************


T_ERROR1  BCLR    READFLG,FLAGREG3       .. set the read flag to let the
*                                           polling routine know to change
          BCLR    TCAP,TCR
          LDA     ERR_CNT
          CMP     #100   (110)
          BHS     CNT_DON

          INC     ERR_CNT
          BRA     END_ERR


**** CHECK REFERENCE ERROR REQUEST

CNT_DON
         LDA     ERR_REQ
         STA     ERR_REG

*
END_ERR   CLR     DSCHGCTR       .. reset the thermistor read routine
          CLR     CHGCTR            program counters to start over
          CLR     NUMSAMP
          CLR     MSBCNTR
          CLR     LSBCNTR
          CLR     LL_READ
          CLR     LL_READ+1
          CLR     REFMSB2
          CLR     REFLSB2
          CLR     FLAGREG3
          BCLR    THERM,PORTC
          BCLR    REF,PORTC
          LDA     #DSCHGDDR
          STA     DDRC
*************
******
          JSR       SERIAL
******
*************
```

-30-

```
END_CNT    RTS
```

What is claimed:

1. A method for testing a thermistor temperature sensor used in a temperature control system having an air supply duct, a microprocessor control for controlling the energization of electric heating elements and a blower motor to circulate air heated by the heating elements in which the thermistor sensor and a capacitor form a charge circuit coupled to a power source port of the microprocessor control, the microprocessor control having a time capture port coupled to the capacitor adapted to capture time expended in charging the capacitor comprising the steps of placing the thermistor sensor in heat conductive relation with air supplied through the duct, turning on the power source port to the charge circuit, initiating a watch dog timer, capturing the time period for charging the capacitor, comparing the time expended with previously determined maximum and minimum time values indicative of normal operation of the thermistor to determine whether the thermistor has operated within the accepted range and setting a final error flag if the time capture is outside the acceptable range and de-energizing the heating elements in the event that the temperature of the thermistor rises to a maximum permissible level.

2. A method according to claim 1 in which a precision reference resistor is connected to another power source of the microprocessor and to the capacitor in the charge circuit further comprising the steps of turning on the said another power source port to the charge circuit, initiating the watch dog timer, capturing the timer period for charging the capacitor and comparing the time expended with previously determined maximum and minimum time values indicative of normal operation.

3. A method according to claim 1 further including the steps of turning off the power source port, initiating a watch dog timer, enabling the time capture port and setting a final error flag if the time capture port sees a high during a selected period of time thereby indicating a failed thermistor sensor.

4. A method according to claim 3 including the step of initiating a default mode of operation of the microprocessor control after a final error flag is set.

5. A method according to claim 1 including the step of initiating a default mode of operation of the microprocessor control after a final error flag is set.

6. A method for testing for electrical leakage of a temperature responsive thermistor sensor used in a temperature control system having a power supply with two grounds of different potentials, the thermistor sensor being coupled to a microprocessor control comprising the steps of coupling one of the power supplies to the thermistor sensor, turning off the said one of the power supplies to the thermistor sensor and then determining whether a potential exists across the thermistor sensor greater than a selected threshold level thereby indicating leakage from the other of the two different power supplies.

7. A method according to claim 4 in which the temperature control system has an air supply duct and the microprocessor controls the energization of heating elements and a blower motor to circulate air heated by the heating elements in which the default mode of operation includes energization of the blower motor.

8. A method according to claim 1 in which the acceptable range is between approximately 10 and 3668 clock cycles for a clock having a frequency of 2 mHz.

9. A method according to claim 2 in which the maximum and minimum time values are approximately 20 to 160 clock cycles for a clock having a frequency of 2 mHz.

10. A method for testing for electrical leakage of a thermistor sensor used in a temperature control system having a power supply with at least two grounds of different potential and a microprocessor control in which the thermistor sensor and a capacitor are components of a timed charged circuit having a logic power source with a logic ground for charging the capacitor comprising the steps of turning off the logic power source, initiating a watch dog timer, enabling a time capture port coupled to the capacitor adapted to stop the watch dog timer upon being subjected to a high due to charging of the capacitor and setting a final error condition flag if the timer capture port is exposed to a high during a selected watch dog period of time.

11. A temperature control system for providing an electrical signal for controlling temperature modifying means comprising:

a power supply having a logic ground and a chassis ground at two different potentials, a microprocessor control being tied to logic ground and having a timer and a timer capture port to turn off the timer when enabled and subjected to a selected high voltage, at least one temperature responsive thermistor sensor to sense temperature at a selected location coupled to the microprocessor control, a diagnostic system for testing the integrity of the at least one temperature responsive thermistor sensor including a capacitor coupled to the thermistor sensor to form an RC charge circuit, the capacitor being coupled to the timer capture port, power source means for applying a potential to the at least one thermistor sensor, means for turning off the power source means, discharging the capacitor and then enabling the time capture port and initiating a selected watch dog period whereby the existence of a voltage sufficiently high to cause a capture of the timer capture port during the watch dog period reflects a leakage fault condition of the at least one thermistor sensor with current passing through the thermistor to chassis ground to charge the capacitor.

12. A temperature control system according to claim 11 including means to apply a selected potential to the at least one thermistor sensor and at the same time initiating the timer, the timer being stopped upon charging of the capacitor to a selected voltage and means for comparing the time expended in charging the capacitor with first selected maximum and minimum time values whereby charge times falling outside the first selected maximum and minimum time values reflect a fault condition of the at least one thermistor sensor.

13. A temperature control system according to claim 11 further including a reference resistor coupled to the capacitor and means to apply a selected potential to the reference resistor and at the same time initiating the timer, the timer being stopped upon charging of the capacitor to a selected voltage and means for comparing the time expended in charging the capacitor with second selected maximum and minimum values whereby charge times falling outside the second selected maximum and minimum time values reflect a fault condition of the at least one thermistor sensor.

14. A temperature control system according to claim 12 in which the first maximum and minimum time values overlap the second maximum and minimum time values.

15. A temperature control system according to claim 11 in which the at least one thermistor sensor is disposed in an air supply duct.

16. A temperature control system according to claim 11 in which the at least one thermistor sensor is disposed in heat conductive relationship with a liquid line of an evaporator.

17. A temperature control system according to claim 16 in which another thermistor sensor is disposed in heat transfer relationship with ambient air and together with the at least one thermistor sensor are used to control the timing of a defrost cycle of the compressor.

18. A temperature control system according to claim 11 further including means for generating a default operation signal when a fault condition is reflected.

19. A method according to claim 6 in which the thermistor sensor is coupled to an A/D input of the microprocessor.

20. A method according to claim 6 in which the thermistor sensor is coupled to a timed charge circuit which in turn is coupled to the microprocessor.

* * * * *